US009912093B2

(12) United States Patent
Williams

(10) Patent No.: US 9,912,093 B2
(45) Date of Patent: Mar. 6, 2018

(54) ELECTRICAL CONNECTOR

(71) Applicant: Connec Limited, Rushcutters Bay, New South Wales (AU)

(72) Inventor: Stephen Williams, Rushcutters Bay (AU)

(73) Assignee: Connec Limited, Rushcutters Bay, New South Wales (AU)

( * ) Notice: Subject to any disclaimer, the term of this patent is extended or adjusted under 35 U.S.C. 154(b) by 0 days.

(21) Appl. No.: 15/320,726

(22) PCT Filed: Nov. 27, 2014

(86) PCT No.: PCT/AU2014/001077
§ 371 (c)(1),
(2) Date: Dec. 20, 2016

(87) PCT Pub. No.: WO2016/011475
PCT Pub. Date: Jan. 28, 2016

(65) Prior Publication Data

US 2017/0133784 A1 May 11, 2017

(30) Foreign Application Priority Data

Jul. 24, 2014 (AU) ..... 2014902876

(51) Int. Cl.
*H01R 13/648* (2006.01)
*H01R 13/504* (2006.01)

(52) U.S. Cl.
CPC ..... *H01R 13/5045* (2013.01); *H01R 13/648* (2013.01); *H01R 2201/20* (2013.01)

(58) Field of Classification Search
CPC H01R 13/5045; H01R 13/5213; H01R 13/53; H01R 13/512; H01R 13/7135;
(Continued)

(56) References Cited

U.S. PATENT DOCUMENTS 2,547,394 A 4/1951 Ibrell
3,328,744 A 6/1967 Fiske
(Continued)

FOREIGN PATENT DOCUMENTS

FR 2 979 489 A1 3/2013
WO WO 91/15039 A1 10/1991

OTHER PUBLICATIONS

International Search Report dated Dec. 24, 2014 mailed in Application No. PCT/AU2014/001077 filed Nov. 27, 2014.
(Continued)

*Primary Examiner* — Jean F Duverne
(74) *Attorney, Agent, or Firm* — Knobbe, Martens, Olson & Bear, LLP

(57) ABSTRACT

An electrical connection component that is suitable for transmission of power with voltage levels greater than or equal to 1 kV and comprises a housing having an internal region, and having a machine cable end, a connection end, an electrical contact assembly, at least a portion of which is arranged at the connection end of the housing, the electrical contact assembly being arranged for electrically coupling with a further electrical contact assembly of another electrical connection component. The electrical connection component also comprises a removable member disposed at least partially within the housing at the connection end to provide a closure of an end portion of the housing to reduce contamination of the internal region. The housing and the removable member are arranged such that at least a portion of the internal region can be inspected when the removable member has been at least partially removed from the housing.

18 Claims, 5 Drawing Sheets

(58) Field of Classification Search
CPC ..... H01R 13/521; H01R 13/648; H01R 4/22; H01R 2201/20
USPC ..... 439/607.05
See application file for complete search history.

(56) References Cited

U.S. PATENT DOCUMENTS 3,382,475 A 5/1968 Kramer
3,555,487 A 1/1971 Jones
3,945,708 A 3/1976 Griffin
4,142,770 A 3/1979 Butler, Jr. et al.
4,417,736 A 11/1983 Herrmann, Jr.
4,420,202 A 12/1983 Atakkaan
5,154,638 A 10/1992 Sireul et al.
5,503,569 A 4/1996 Huss, Jr. et al.
5,580,266 A 12/1996 Shelly
5,626,486 A * 5/1997 Shelly ..... H01R 13/53 439/273
5,785,543 A 7/1998 Dietrich
5,801,465 A 9/1998 Yamada
6,485,326 B1 * 11/2002 Trainor ..... H01R 4/22 174/91
6,517,368 B2 2/2003 Hara et al.
6,641,421 B1 * 11/2003 Leavitt ..... H01R 13/53 439/271
7,229,303 B2 6/2007 Vermoesen et al.
7,419,397 B2 * 9/2008 Casperson ..... H01R 13/521 439/281
7,632,120 B2 * 12/2009 Hughes ..... H01R 13/7135 439/185
7,690,936 B1 4/2010 Snekkevik et al.
8,460,015 B2 6/2013 Deno et al.
9,620,903 B2 4/2017 Joo et al.
2008/0139030 A1 6/2008 Milo
2012/0034825 A1 2/2012 Yuan
2012/0100737 A1 4/2012 Frey
2013/0095700 A1 4/2013 Shultz
2013/0102176 A1 * 4/2013 Kazubowski ..... H01R 13/512 439/275
2013/0130525 A1 * 5/2013 Hachadorian ..... H01R 13/5213 439/142
2013/0189865 A1 7/2013 Zaiser et al.
2014/0106616 A1 4/2014 DeVries et al.
2014/0141658 A1 5/2014 Bazenas et al.
2014/0273599 A1 9/2014 O'Sullivan et al.
2015/0104964 A1 4/2015 McIntosh et al.
2016/0126641 A1 5/2016 Lewin et al.
2016/0172777 A1 6/2016 Bellet

OTHER PUBLICATIONS

Supplementary European Search Report dated May 26, 2017 for corresponding EP Application No. 14898109.5, filed Nov. 27, 2014, in 8 pages.

* cited by examiner

ELECTRICAL CONNECTOR

FIELD OF THE INVENTION

The present invention relates to an electrical connector used in high power applications. In particular the present invention relates to a connector suitable for using in demanding environments such as the petroleum or mining industry.

BACKGROUND OF THE INVENTION

Reliable electrical connections are crucial in high power applications, such as powering of heavy electrical machinery often used in the mining, tunneling or petroleum industries, or connecting of power transportation lines. In these applications the electrical cables carry powers in the order of several kilowatts and voltages in the order of kilovolts.

Typical electrical connectors used in the art have a plurality of pins or sockets each connected to a core of an electrical cable. Depending on their specific application, the connectors must comply with a series of requirements often listed in standards and/or regulations. The compliance of the connectors with the relevant standards is generally certified by a certifying body.

The certification of a connector for a specific application does generally ensure that the connector meets the basic safety requirements in compliance with local laws. Certified connectors, although being safe to operate, often miss specific features which would provide operational advantages in specific applications.

For example, high power connectors used in demanding environments such as mining sites, are often subject to harsh treatment, and can suffer structural damage which, in severe cases, can interrupt the electrical connections of one or more of the phase connections.

Damaged connectors should be repaired promptly to avoid affecting the site operation. The first step for repairing a connector is to identify where the damage has occurred and then, if possible, replace the damaged component. High power connectors in the art do not provide features which allow an efficient inspection of the inner components of the connectors making the identification of the damage a challenging task. Further, even if the damage is identified, often it is impractical or not possible to replace the single damaged part. In this case the connector has to be replaced. Replacing electrical connectors in a mining site, for example, may critically affect the operations, in terms of efficiency and costs.

SUMMARY OF THE INVENTION

Embodiments of the present invention aim to provide an electrical connector which facilitates inspection of an internal region of the electrical connector for damage.

In accordance with a first aspect, the present invention provides an electrical connection component for a machine cable, the electrical connection component being suitable for transmission of power with voltage levels greater than or equal to 1 kV, the electrical connection component comprising:

- a housing having an internal region, and having a machine cable end and a connection end;
- an electrical contact assembly, at least a portion of which is arranged at the connection end of the housing, the electrical contact assembly being arranged for electrically coupling with a further electrical contact assembly of another electrical connection component; and
- a removable member, disposed at least partially within the housing at the connection end, the removable member being arranged to provide a closure of an end portion of the housing to reduce contamination of the internal region;
- wherein the housing and the removable member are arranged such that at least a portion of the internal region can be inspected when the removable member has been at least partially removed from the housing.

The housing and the removable member may be arranged such that the at least a portion of the internal region can be inspected when the removable member has been at least partially removed from the housing without having to disconnect components of the electrical contact assembly from a core of the machine cable. The electrical connection component may be arranged such that all components of the electrical connection component remain in place apart from the removable member when the removable member is removed from the housing.

In an embodiment, the removable member is adapted to receive at least a portion of the electrical contact assembly in a manner such that the electrical contact assembly electrically couples to the further electrical contact assembly, through the removable member, when the connection component is connected with the further electrical contact assembly. When the removable member is removed from the housing, a portion of the electrical contact assembly may be made accessible for repair or replacement.

The portion of the electrical contact assembly made accessible for repair or replacement may comprise a connection portion between the electrical contact assembly and a core of the machine cable.

The electrical contact assembly may comprise at least one tube that is arranged for receiving at an electrical conductor, the tube comprising a first material comprising an insulating material, the first material surrounding a length of the electrical conductor that has been received by the tube, and a second material comprising a conductive material arranged to be electrically couplable to an earth of the machine cable, the second material surrounding the first material substantially along a length of the at least one tube.

In an embodiment, the housing comprises a substantially cylindrically shaped body with an open end at the connection side.

In some embodiments, the removable member comprises a substantially cylindrically shaped inspection plug. The inspection plug and the housing may be shaped such that the inspection plug form-fits into the housing at the end portion of the housing and around the electrical contact assembly.

The housing and the inspection plug may comprise of a high density polymeric material.

In some embodiments the inspection plug comprises a first plug element and a second plug element adapted to form-fit with one other.

The first plug element may be disposed in proximity to the opening of the housing and the second plug element may be disposed within the internal region of the housing. The first and the second plug elements may be independently removable from the housing.

In some embodiments the electrical connection component further comprises a fastening arrangement for fastening the removable member to the housing.

The fastening arrangement may comprise a plurality of bolts arranged so as to engage with the removable member through respective bore holes. The removable member may be arranged such that it can be removed by pulling the removable member along an axis of the electrical connection component. It will be appreciated that the fastening arrangement may be any appropriate arrangement, and may comprise a hinge arrangement or similar whereby the removeable member may be swung outwardly to reveal the at least a portion of the internal region for inspection while the removeable member is still connected to the housing.

In accordance with a second aspect, the present invention provides an electrical connection component for a machine cable, the electrical connection component being suitable for transmission of power with voltage levels greater than or equal to 1 kV, the electrical connection component comprising:

- a cylindrical polymeric housing having an internal region, and having a machine cable end and a connection end,
- an electrical contact assembly comprising at least three electrical pins each having a respective phase tube and earth connection, at least a portion of the electrical contact assembly being arranged at the connection end of the housing and being arranged for electrically coupling with respective contact assemblies of another connection component; and
- a polymeric cylindrical plug, disposed at least partially within the housing which, when removed from the housing, exposes at least a portion of the internal region to enable identification and repair of at least a portion of the electrical contact assembly.

In accordance with a third aspect, the present invention provides a method of manufacturing an electrical connection component, the electrical connection component being in accordance with the first or the second aspect of the present invention, the method comprising the steps of:

- forming a polymeric housing by injection moulding of a polymeric material;
- forming a removable member adapted to at least partially form-fit into an opening of the housing;
- fitting at least a portion of an electrical contact assembly within the housing; and
- form-fitting the removable member to the housing and the electrical contact assembly.

In accordance with a fourth aspect, the present invention provides a method of repairing an electrical connection component, the electrical connection component being in accordance with the first or the second aspect of the present invention, the method comprising the steps of:

- removing a removable member from a housing of the connection component;
- inspecting an internal region of the housing of the connection component for damage to at least a portion of an electrical contact assembly disposed at least partially inside the internal region;
- repairing or replacing the damaged portion of the electrical contact assembly;
- refitting the removable member to the housing of the connection component.

The invention will be more fully understood from the following description of specific embodiments of the invention. The description is provided with reference to the accompanying drawings.

DETAILED DESCRIPTION OF SPECIFIC EMBODIMENTS

Embodiments described herein provide an electrical connection component suitable for high power applications for connecting a machine cable. The connection component has a front removable member which, when removed, provides access to the internal region of the connector, allowing a user to identify damage that may have been caused to the internal connections, and to replace damaged parts.

Figure 1:
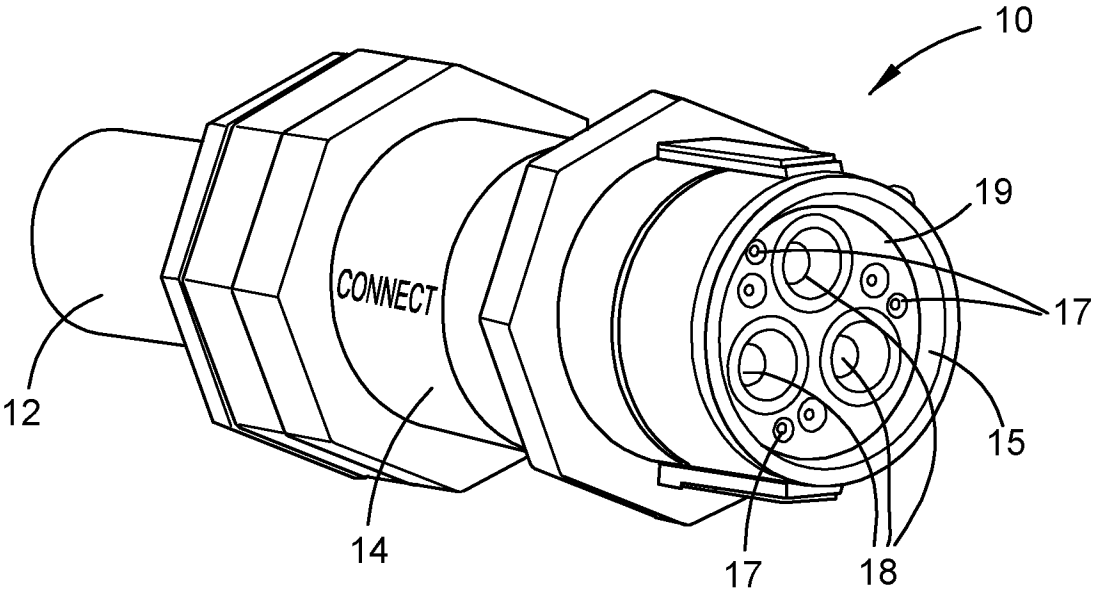
FIG. 1 is an isometric view of an electrical connection component in accordance with an embodiment of the present invention.

Referring initially to FIG. 1 there is shown an electrical connection component 10 for a machine cable 12, which is suitable for transmission of power with voltage levels greater than or equal to 1 kV. The electrical connection component has a housing which defines an internal region of the connection component 10. In the embodiment described, the housing is in the form of a substantially cylindrically shaped body 14 defining a receptacle with an opening 15. The body 14 comprises a high density polymeric material The housing has a machine cable end and a connection end, and incorporates at least a portion of a first contact assembly. In the embodiment described the first contact assembly comprises three separate electrical conductors 18, each being arranged in a respective phase tube. The phase tube comprises a first material comprising an insulating material, the first material surrounding a length of the at least one electrical conductor that has been received by the phase tube, and a second material comprising a conductive material arranged to be electrically couplable to an earth of the machine cable, the second material surrounding the first material substantially along a length of the phase tube.

The first contact assembly allows coupling with a second contact assembly to create an electrical connection. The electrical connection component 10 has a removable member, disposed at least partially within the body 14 at the connection side and being arranged to provide a closure of an open portion of the housing 14 to reduce contamination of the internal region. The removable member occupies a volume at an end of the body 14 in proximity to the first contact assembly. The presence of the removable member minimises an amount of air in the proximity of the electrical contacts and consequently reduces a likelihood of discharge or even explosion. However, each phase tube may have a flame path to minimise the risk of explosion inside the phase tube. The flame path is defined by an inner surface of the phase tube which is disposed in proximity to a respective electrical pin. The space gap between the electrical pin and the inner surface of the phase tube is sufficiently narrow to minimise the risk of an explosion.

In the embodiment described the removable member is in the form of a substantially cylindrically shaped inspection plug 19. The inspection plug 19 form-fits into the body 14 of the housing. The plug 19 has three openings to receive the three electrical pins 18, each having a respective phase tube and earth connection element, so that an electrical connection can be created with a coupling electrical connection component when the plug 19 is inserted into the body 14.

The plug 19 is secured to the body 14 of the housing by three bolts 17 which engage respective threaded holes (not shown) of the body 14. The plug 19 can be removed from the body 14 by removing the bolts 17 and sliding the plug 19 out of the opening 15, typically in a direction along an axis of the electrical connection component 10. When the plug 19 is removed from the body 14 a portion of the internal region of the body 14 is exposed for inspection. In case of suspected damage of the plug during operation, a user can remove the plug 19 and inspect the internal region of the connection component 10 for damage. For example, in some operating conditions, one or more of the pins 18 or the respective phase tubes may be damaged due to an explosion inside the connector. The damaged pin 18 or phase tube can be identified and repaired or replaced after removing the plug 19.

Advantageously, the body 14 and the plug 19 are arranged such that the portion of the internal region of the body 14 can be inspected when the plug 19 has been removed from the body 14 without having to disconnect components of the electrical connection component 10 from a core of the machine cable 12. The electrical connection component 10 is arranged such that all components of the electrical connection component 10 apart from the plug 19 remain in place when the plug 19 is removed from the housing.

Although in the above example the plug 19 is arranged such that it can be removed by pulling along an axis of the electrical connection component 10, it will be appreciated that the plug 19 can be fastened by any other appropriate means. For example the plug 19 may be coupled to the body 19 by a hinge arrangement whereby the plug 19 can be swung outwardly to reveal the portion of the internal region of the body 19.

A user may decide to repair or replace different parts of the first contact assembly depending on the type and amount of damage. In the embodiment described, the plug 19 is provided in the form of two separate plug elements so that a user may conveniently decide to remove one or two plug elements. For example, a user may decide to remove only one plug element to inspect the connector, and both plug elements to repair the connector.

Figure 2C:
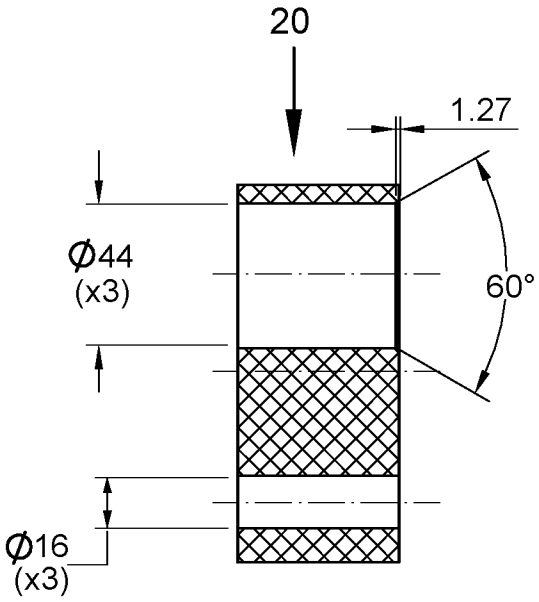
FIGS. 2 and 3 show different views of internal parts of the electrical connection component of FIG. 1.
Figure 2B:
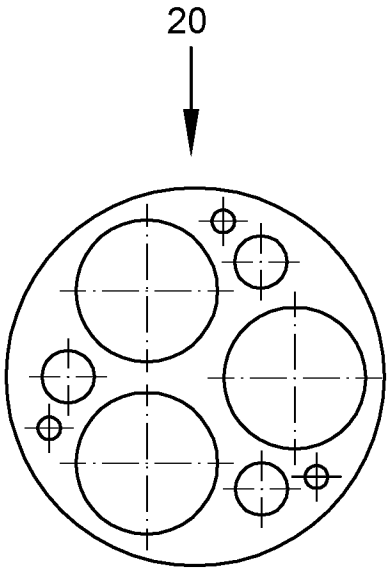
Figure 2A:
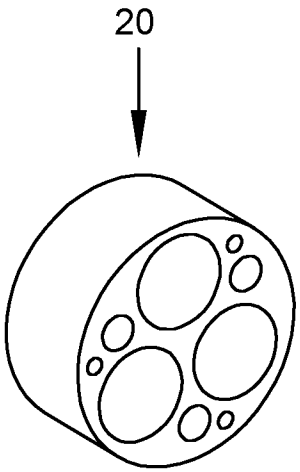
Figure 3A:
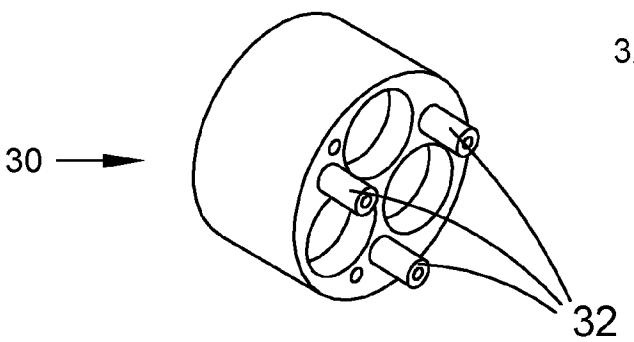
Figure 3B:
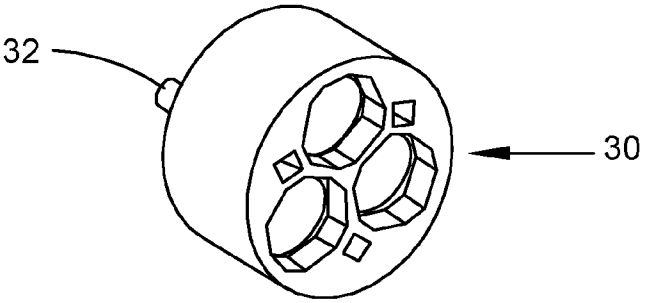
Figure 3C:
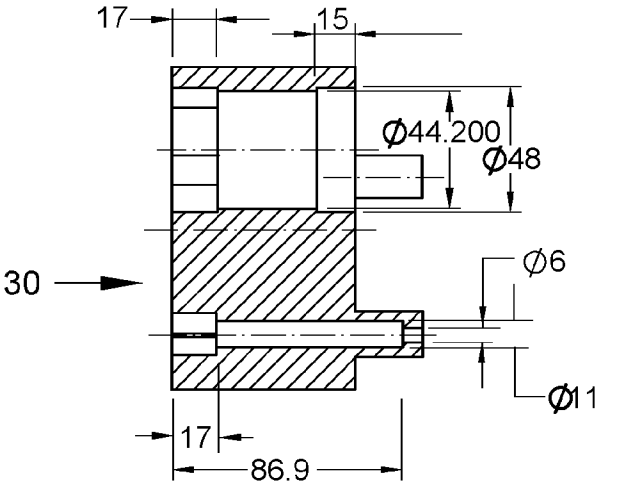
Figure 3D:
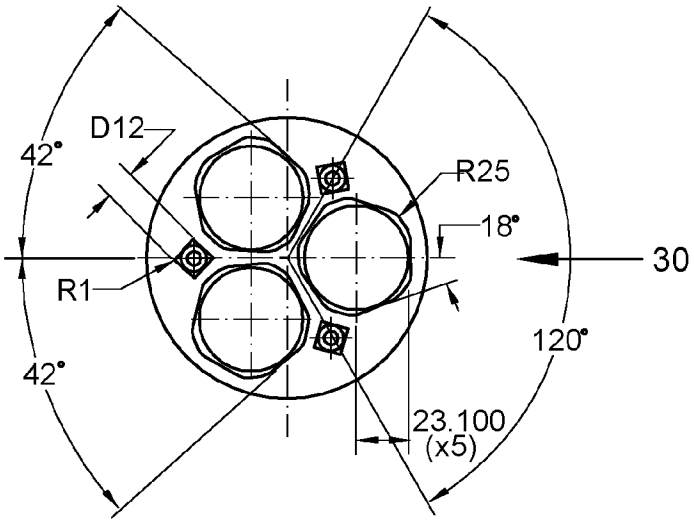

Referring now to FIGS. 2 and 3, there is shown a first plug element 20 and a second plug element 30. Depending on the application of the connection component, the plug elements 20 and 30 comprise high density polymeric materials. The first plug element 20 is disposed in proximity to the opening of the body 14 and the second plug element 30 is disposed inside the body 14. Both plug elements 20 and 30 can be independently removed from the body 14 after removing the bolts 17. The second plug element 30 has a plurality of bosses 32 which engage respective recesses in the first plug element 20 so that the two plug elements 20 and 30 form-fit with one another.

Figure 4:
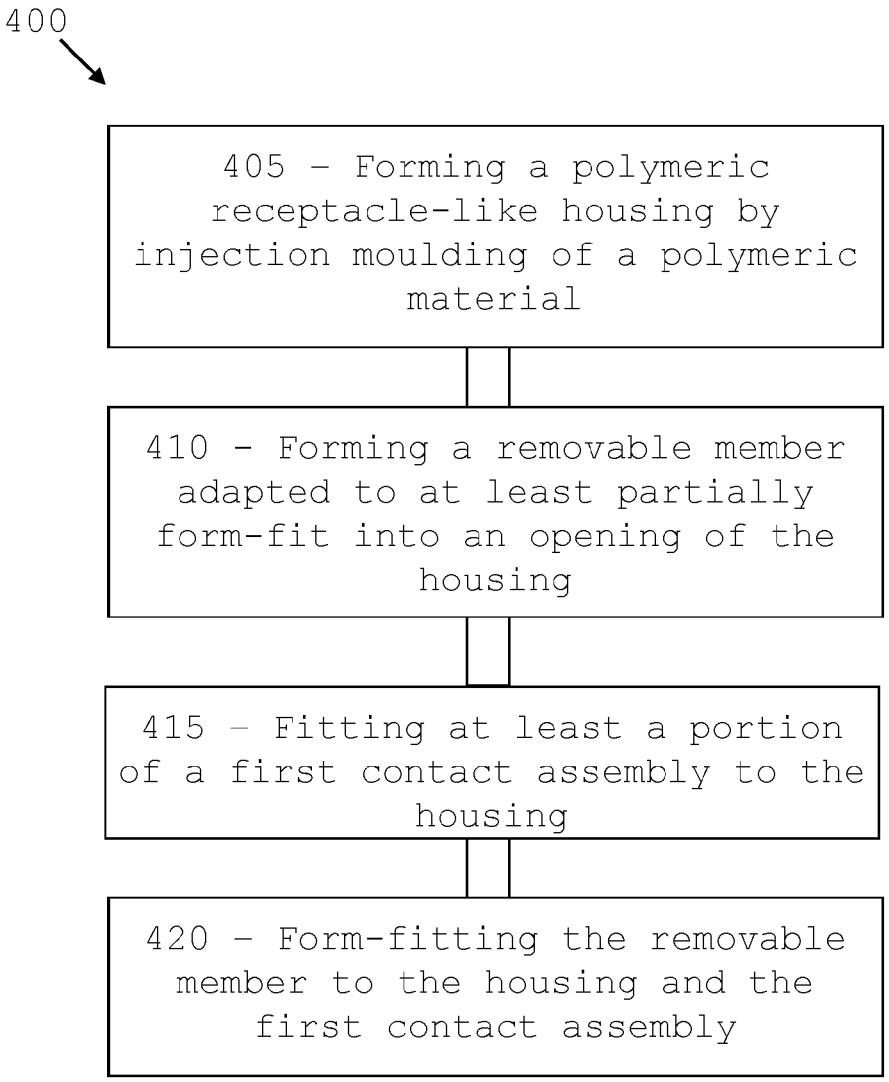
FIG. 4 shows a flow-chart with a series of method steps for manufacturing an electrical connection component for a machine cable in accordance with an embodiment of the present invention.

Referring now to FIG. 4, there is shown a flow-chart with a series of method steps for manufacturing an electrical connection component for a machine cable in accordance with the embodiment described.

In step 405 a polymeric receptacle-like housing is formed by injection moulding of a polymeric material. In step 410 the two polymeric plug elements 20 and 30 are formed in a manner such that they form-fit into an opening of the housing formed in step 405. The housing and the plug elements may comprise high density polymers.

In step 415 at least a first contact assembly is fitted to the housing. Further, in step 420, the two polymeric plug elements 20 and 30 are form-fitted to the housing and to the first contact assembly.

Figure 5:
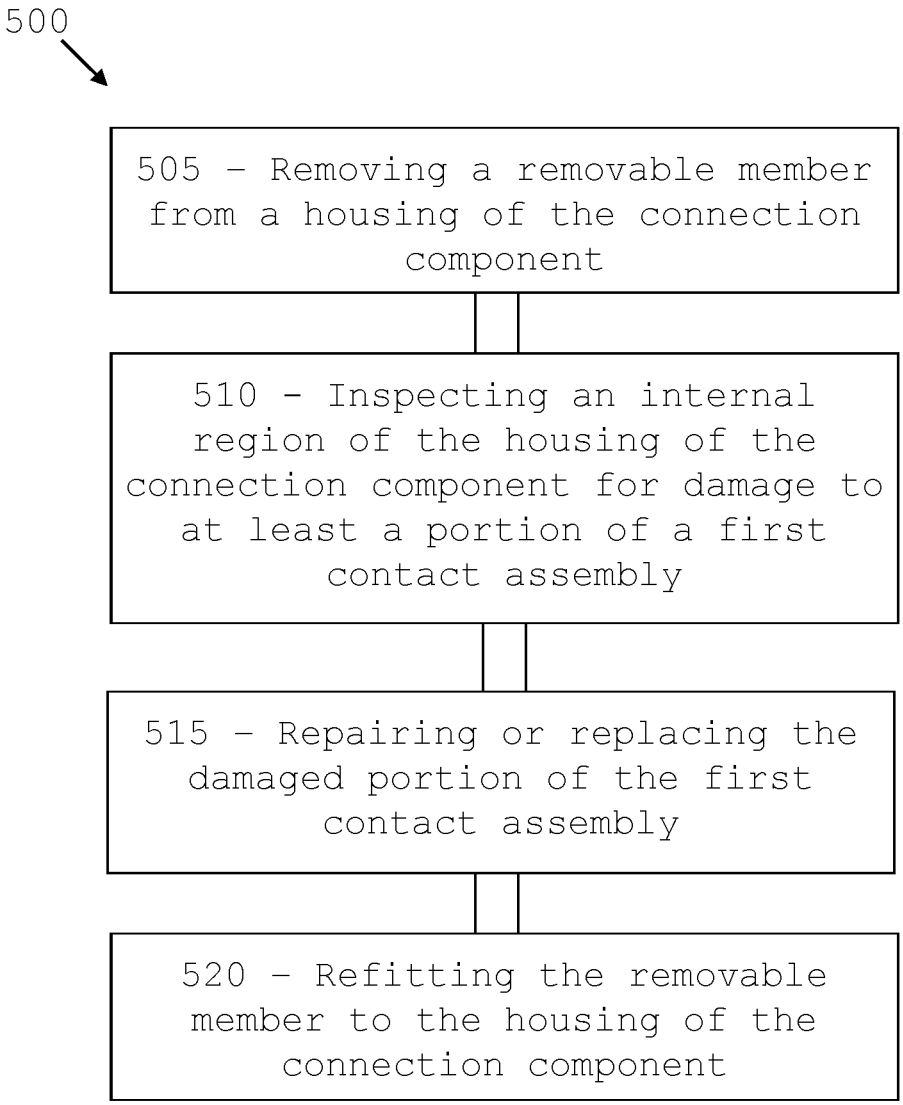
FIG. 5 shows a flow-chart with a series of method steps for repairing an electrical connection component for a machine cable in accordance with an embodiment of the present invention.

Referring now to FIG. 5, there is shown a flow-chart with a series of method steps for repairing an electrical connection component for a machine cable in accordance with the embodiment. In step 505, the first polymeric plug element 20, or both plug elements 20 and 30, are removed from the housing of the connection component. In step 510, the internal region of the housing is then inspected for damage that may have been caused to at least a first contact assembly disposed at least partially inside the internal region. In step 515, the damaged first contact assembly is repaired or replaced and, finally, the first polymeric plug element 20, or both plug elements 20 and 30, are refitted to the housing in step 520.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An electrical connection component for a machine cable, the electrical connection component being suitable for transmission of power with voltage levels greater than or equal to 1 kV, the electrical connection component comprising:

a cylindrical polymeric housing having an internal region, and having a machine cable end and a connection end, an electrical contact assembly comprising at least three electrical pins each having a respective phase tube and earth connection, at least a portion of the electrical contact assembly being arranged at the connection end of the housing and being arranged for electrically coupling with a respective contact assembly of another connection component; and a removable inspection plug comprising at least three passages for receiving the at least three phase tubes and respective electrical pins therewithin, the inspection plug being disposed at least partially within the housing;

wherein when the inspection plug is entirely removed from the housing, at least a portion of the internal region is exposed to enable inspection of at least a portion of the electrical contact assembly while the electrical pins and respective phase tubes are retained in position.

2. The electrical connection component of claim 1, wherein the housing and the inspection plug are arranged such that the at least a portion of the internal region can be inspected when the inspection plug has been at least partially removed from the housing without having to disconnect components of the electrical contact assembly from a core of the machine cable.

3. The electrical connection component of claim 1, wherein the inspection plug comprises a first plug element and a second plug element adapted to form-fit with one other.

4. The electrical connection component of claim 3, wherein the first plug element is disposed in proximity to the opening of the housing and the second plug element is disposed within the internal region of the housing.

5. The electrical connection component of claim 3, wherein the first and the second plug elements are independently removable from the housing.

6. The electrical connection component of claim 1, wherein the inspection plug is adapted to receive at least a portion of the electrical contact assembly in a manner such that the electrical contact assembly electrically couples to the further electrical contact assembly, through the inspection plug, when the connection component is connected with the further electrical contact assembly.

7. The electrical connection component of claim 1, wherein, when the inspection plug is removed from the housing, a portion of the electrical contact assembly is made accessible for repair or replacement.

8. The electrical connection component of claim 7, wherein the portion of the electrical contact assembly made accessible for repair or replacement comprises a connection portion between the electrical contact assembly and a core of the machine cable.

9. The electrical connection component of claim 1, wherein the inspection plug is adapted to receive at least a portion of the electrical contact assembly in a manner such that the electrical contact assembly electrically couples to the further electrical contact assembly, through the inspection plug, when the connection component is connected with the further electrical contact.

10. The electrical connection component of claim 1, wherein the electrical contact assembly comprises at least one tube that is arranged for receiving an electrical conductor, the tube comprising a first material comprising an insulating material, the first material surrounding a length of the electrical conductor that has been received by the tube, and a second material comprising a conductive material arranged to be electrically couplable to an earth of the machine cable, the second material surrounding the first material substantially along a length of the at least one tube.

11. The electrical connection component of claim 1, wherein the housing comprises a substantially cylindrically shaped body with an open end at the connection side.

12. The electrical connection component of claim 1, wherein the inspection plug and the housing are shaped such that the inspection plug form-fits into the housing at the end portion of the housing and around the electrical contact assembly.

13. The electrical connection component of claim 1, wherein the housing and the inspection plug comprise a polymeric material.

14. The electrical connection component of claim 13, wherein the polymeric material comprises a high density polymeric material.

15. The electrical connection component of claim 1, further comprising a fastening arrangement for fastening the inspection plug to the housing.

16. The electrical connection component of claim 15, wherein the fastening arrangement comprises a plurality of bolts arranged so as to engage with the inspection plug through respective bore holes.

17. The electrical connection component of claim 15, wherein the fastening arrangement comprises a hinge arrangement whereby the inspection plug may be swung outwardly to reveal the at least a portion of the internal region for inspection while the inspection plug is still connected to the housing.

18. The electrical connection component of claim 13, wherein the inspection plug is arranged such that it can be removed by pulling along an axis of the electrical connection component.

* * * * *